United States Patent [19]

Schmidberger et al.

[11] Patent Number: 4,698,096

[45] Date of Patent: Oct. 6, 1987

[54] SINTERING PROCESS

[76] Inventors: Rainer Schmidberger, Reussenbachstrasse 33; Sylvia Härdtle, Bernhardstrasse 43/2, both of 7778 Markdorf, Fed. Rep. of Germany

[21] Appl. No.: 789,479

[22] Filed: Oct. 21, 1985

[30] Foreign Application Priority Data

Oct. 20, 1985 [DE] Fed. Rep. of Germany ..... 3438547

[51] Int. Cl.[4] ..... C22C 1/04

[52] U.S. Cl. ..... 75/248; 419/47; 419/48; 419/54; 419/58; 419/60; 420/430; 420/590

[58] Field of Search ..... 420/430, 590; 419/47, 419/58, 48, 60, 54; 75/248

[56] References Cited

U.S. PATENT DOCUMENTS

| | | | |
|---|---|---|---|
| 3,888,636 | 6/1975 | Sczerzenie et al. | 75/248 |
| 3,890,145 | 6/1975 | Hivert et al. | 75/245 |
| 3,958,316 | 5/1976 | Larsen et al. | 75/245 |
| 3,979,209 | 9/1976 | Snyder | 75/248 |
| 3,979,234 | 9/1976 | Northcutt et al. | 419/29 |
| 3,988,118 | 10/1976 | Grierson et al. | 75/248 |
| 4,090,875 | 5/1978 | Ludwig | 75/248 |
| 4,431,448 | 2/1984 | Merzhanov et al. | 75/238 |

*Primary Examiner*—Stephen J. Lechert, Jr.

*Attorney, Agent, or Firm*—Weissenberger, Hammond & Littell

[57] ABSTRACT

This invention relates to a sintering process. More particularly, this invention relates to a process for preparing a sintered form having a tungsten content which comprises the steps of:

(a) sintering a porous form of pressed tungsten alloy powders having a high tungsten content in solid phase, and (b) heat treating the sintered part from step (a) in a liquid phase.

13 Claims, 2 Drawing Figures

SINTERING PROCESS

FIELD OF THE INVENTION

This invention relates to a sintering process. More particularly, this invention relates to a sintering process wherein sintering in solid phase is followed by brief heat treatment with a liquid phase.

BACKGROUND OF THE INVENTION

In conventional sintering of multiphase tungsten alloys, the metals are mixed as powders, pressed, and sintered in liquid phase. With tungsten alloys this is done at temperatures higher than 1450° C. Within the liquid phase at least three things must occur:

(1) formation of alloy;

(2) coating of the tungsten granules; and (3) densification of the pressed body.

The necessarily long stay in the liquid phase results in strong granule growth, which results in strength decrease.

From U.S. Pat. No. 4,498,395, incorporated herein by reference, are known tungsten alloy powders which are already pre-alloyed, i.e., the tungsten grains are already coated with the binder phase. Pressed bodies of this powder are compacted by solid phase sintering, and the sintered parts are characterized by a polygonal structure of the tungsten phase. The structure is considerably finer than the ones of conventional tungsten heavy metal compositions which are prepared from the individual powders (W, Ni, Fe) by mixing, pressing, and sintering in liquid phase. The polygonal structure of the tungsten particles in compositions prepared according to U.S. Pat. No. 4,498,395 shows, however, a high contiguity of the tungsten phase, which means that there is a multitude of tungsten-tungsten grain boundaries. This situation can negatively effect the mechanical properties of the sintered tungsten heavy metals. There is impairment of the tensile strength and elongation at break especially if the alloy contains interstitial impurities such as oxygen, phosphorus, or sulfur and/or other components which are insoluble in tungsten. These impurities separate off at the tungsten grain boundaries and cause the grain boundary brittleness typical of tungsten.

OBJECTS OF THE INVENTION

It is an object of the invention to provide a novel sintering process.

It is also an object of the invention to provide a novel sintering process wherein sintering in the solid phase is followed by brief heat treatment in the liquid phase.

It is a further object of the invention to provide sintered tungsten alloys having improved properties.

These and other objects of the invention will become apparent in the description below.

DETAILED DESCRIPTION OF THE INVENTION

Figure 1:
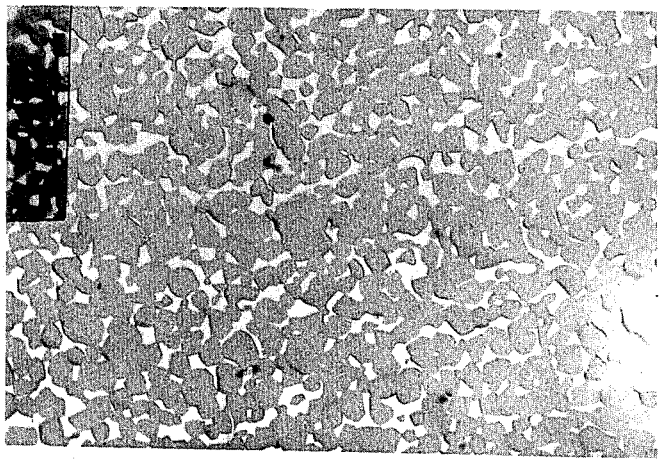
FIG. 1 represents a micrograph of a cross-section of a solid-phase sintered piece.

The invention herein relates to a sintering process for the preparation of sintered bodies with a high tungsten content with a fine-grained structure (smaller than 10 μm of the tungsten grains), which show a low contiguity of the tungsten phase. The problem of preparing suitable tungsten alloys is solved according to the invention by sintering a porous form of pressed tungsten alloy powders in solid phase, followed by brief heat treatment with a liquid phase.

The heat treatment in the liquid phase leads to a rounding of the previously polygonal tungsten grains through dissolution in the molten-liquid binder phase, without the simultaneous occurrence of significant grain growth. This results in an almost spherical shape of the tungsten grains, which decreases the harmful contiguity of the tungsten phase since spheres have less contact planes among each other than do polygons.

The claimed process permits a combination of the advantages of solid phase sintering with liquid phase sintering, without having to contend with the disadvantages of the conventional liquid phase sintering, namely, grain growth. Granular fineness is necessary because it increases strength. (Increase of tensile strength according to the Hall-Petch Equation $$\sigma_s \sim 1/\sqrt{\alpha},$$

wherein $\alpha$ is the mean grain size.)

Grain growth barely occurs in the process according to the invention since the liquid phase is present only during a very short time. During the course of the liquid phase only a rounding of the tungsten granules occurs as a result of the high interfacial tension of tungsten in contact with the liquid binder phase. Alloy formation and densification of the pressed body have already occurred during the powder preparation or during the solid phase sintering, respectively.

The heat treatment with liquid phase preferably lasts from about 2 to 10 minutes, more preferably from about 3 to 8 minutes. After this time the tungsten grains are extensively rounded. Since by the appearance of the liquid phase the sinter body is already densely sintered (remaining porosity $<1\%$), and since there is a relatively high contiguity of the tungsten phase, the demixing of tungsten and binder phases, which occurs with the usual liquid phase sintering, will not happen.

The stay in the liquid phase, which is short as compared to liquid phase sintering, is sufficient to achieve the desired structure transformation. Alloy formation and densification of the porous parts have already occurred at the time of structure transformation, in contrast to liquid phase sintering.

During the solid phase sintering of porous form parts of pressed tungsten heavy metal powder, at least a part of the sintering is preferably carried out under a hydrogen flow to remove the residual oxygen present in the tungsten alloy powders. It is important that the oxygen is substantially removed as long as the sinter parts have open pores. Subsequent to sintering under a hydrogen flow, a vacuum heating should take place to remove the hydrogen dissolved in the sinter part. The dissolved hydrogen can, however, also be removed by heating in an inert gas (e.g., argon). Removal of the hydrogen improves the mechanical properties of the sinter parts.

The solid phase sintering can also be carried out partly in vacuum. In the event there is no subsequent sintering under hydrogen atmosphere, a separate vacuum heating to remove the hydrogen dissolved in the sinter parts can be omitted.

According to the invention the heat treatment with liquid phase can take place immediately after the solid phase sintering or only after the vacuum heating. The atmosphere there can be hydrogen or an inert gas. However, the heat treatment can also occur under high vacuum.

It is important that the time during which the liquid phase is present is well controlled. Too long a stay in the liquid phase leads to undesirable grain growth and thus has to be avoided. It is also important to conduct heating and cooling during the liquid phase as rapidly as possible.

In cases where the heat treatment is carried out under hydrogen atmosphere, a bubble formation in the binder by outgassing of the dissolved hydrogen during cooling-down to the solidification temperature must be avoided, since it can lead to pore formation. For this purpose the cooling rate near the solidification temperature should not be greater than 3° C./minute.

After the solidification range is passed, a further quick cooling (approximately 100° C./minute) to temperatures below about 800° C. also leads to additional improvement of the mechanical properties. The reason for this is presumably the prevention of grain boundary segregation by interfering impurities. Below 800° C. the segregation process is so slow that a normal oven cooling (approximately 20° C./minute) suffices to prevent an impairment of the mechanical properties.

The ductility of the sinter parts is increased by the process according to the invention. Breaking elongation increases because of the structure transformation without significant strength decrease, for example, from about 15 to 40 percent.

Strength and elongation properties of the sintered parts can be modified within a wide range by adjustment of the tungsten grain size via the soaking time in the liquid phase during the structure transformation. Increasing grain growth through heat treatment of longer duration in liquid phase leads to decreasing strength with increasing elongation at break.

Figure 2:
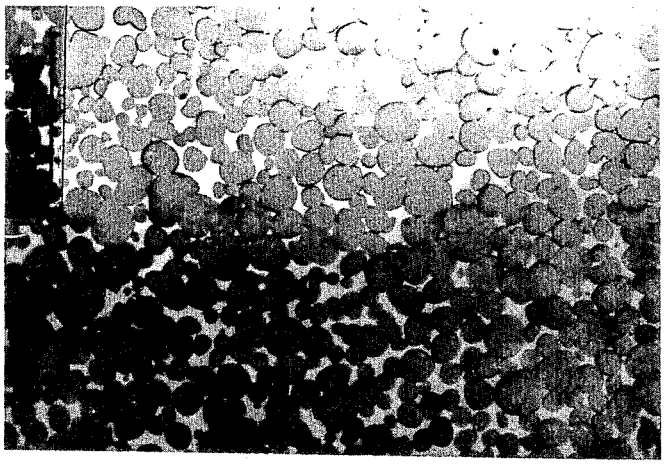
FIG. 2 represents a micrograph of a cross-section of a sintered piece prepared according to the invention.

The effect of the process according to the invention can perhaps be better appreciated by referring to FIGS. 1 and 2. FIG. 1 shows a metallographic micro-section, i.e., a microscopic photograph, or micrograph, of a solid phase sintered tungsten heavy metal alloy with a 90% tungsten content. The polygonal structure of the tungsten grains, which leads to a considerable contiguity of the tungsten phase, can be seen.

FIG. 2 shows a micro-section of a tungsten heavy metal alloy after heat treatment with liquid phase according to the invention. The tungsten granules are barely larger than in the solid phase sintered state. However, due to the rounding of the tungsten granules, a significantly lower contiguity results.

The following examples are intended to illustrate the invention and should not be construed as limiting the invention thereto.

EXAMPLES

Example 1

A tungsten heavy metal alloy powder of the composition 90% W, 6% Ni, 2% Co, and 2% Fe is pressed with a pressure of 300N/mm$^2$. The pressed body is sintered under a hydrogen flow at 1300° C. for five hours and then degassed in a vacuum of $10^{-5}$ mbar at 1050° C. for six hours. The sintered part is subsequently heat treated in said vacuum at 1470° C. for five minutes and then rapidly cooled down. The tensile strength of the sample is 1150N/mm$^2$ with an elongation at break of 30%.

Example 2

A tungsten heavy metal alloy powder having the composition mentioned in Example 1 is pressed with a pressure of 300N/mm$^2$. The pressed body is pre-sintered under a hydrogen flow at 900° C. for ten hours and then final-sintered in a vacuum of $10^{-5}$ mbar at 1360° C. for 20 hours. The sintered part is subsequently heat treated in said vacuum at 1470° C. for 10 minutes. The sample has a tensile strength of 1100N/mm$^2$ with an elongation at break of 40%.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A process for preparing a sintered part having a high tungsten content, which comprises the steps of:

(a) sintering a porous part of pressed tungsten alloy powders having a high tungsten content in solid phase, and (b) heat treating the sintered part from step (a) in a liquid phase for 2 to 10 minutes.

2. The process of claim 1, wherein the sintering of step (a) is carried out in a hydrogen flow and the heat treatment of step (b) is carried out in high vacuum.

3. The process of claim 2, wherein the heat treatment of step (b) is carried out at a pressure equal to or less than $10^{-5}$ mbar.

4. The process of claim 1, wherein the heat treatment of step (b) begins when the pressed body is compacted by the solid phase sintering of step (a) to a porosity of less than 1%.

5. The process of claim 1, wherein prior to the heat treatment of step (b) a degassing of the sintered body from step (a) is carried out by maintaining the sintering temperature in high vacuum comprising a pressure equal to or less than $10^{-5}$ mbar.

6. The process of claim 1, wherein after the heat treatment of step (b), the sintered body is cooled rapidly.

7. The process of claim 1, wherein an alloy powder composition comprising (i) from about 90 to 97% by weight of tungsten and (ii) from about 3 to 10% by weight of nickel, iron, and cobalt in a weight ratio of about 3:1:1, is sintered for about five hours in a hydrogen flow at about 1300° C., the sintered composition is degassed at about 1300° C. in high vacuum for about 30 minutes, and the degassed composition is heated at about 1470° C. in high vacuum for about five minutes and then rapidly cooled to room temperature.

8. The process of claim 7, wherein the high vacuum comprises a pressure equal to or less than $10^{-5}$ mbar.

9. The process of claim 1, wherein the heat treatment of step (b) is carried out until all or substantially all of the tungsten grains have rounded corners.

10. The process of claim 9, wherein the heat treatment of step (b) is carried out until all the tungsten grains have rounded grain boundaries.

11. A process for preparing a sintered body having a high tungsten content, which comprises the steps of:

(a) pressing a quantity of tungsten alloy powders having a high tungsten content to form a pressed porous part;

(b) sintering the pressed porous part from step (a) in solid phase; and (c) heat treating the sintered part from step (b) in a liquid phase for 2 to 10 minutes.

12. A sintered alloy composition prepared according to the process of claim 11.

13. A sintered alloy composition prepared according to the process of claim 1.

* * * * *